US010575565B2

(12) United States Patent
Trebino

(10) Patent No.: US 10,575,565 B2
(45) Date of Patent: Mar. 3, 2020

(54) UNDERWEAR WITH SHIRT TUCKING APPARATUS

(71) Applicant: Andrew Trebino, Carlisle, MA (US)

(72) Inventor: Andrew Trebino, Carlisle, MA (US)

( * ) Notice: Subject to any disclaimer, the term of this patent is extended or adjusted under 35 U.S.C. 154(b) by 224 days.

(21) Appl. No.: 15/594,246

(22) Filed: May 12, 2017

(65) Prior Publication Data

US 2017/0325512 A1 Nov. 16, 2017

Related U.S. Application Data

(60) Provisional application No. 62/363,810, filed on Jul. 18, 2016, provisional application No. 62/335,548, filed on May 12, 2016.

(51) Int. Cl.

| | |
|---|---|
| ***A41B 9/14*** | (2006.01) |
| ***A41F 17/00*** | (2006.01) |
| ***A41B 9/00*** | (2006.01) |

(52) U.S. Cl.

CPC ..... *A41B 9/14* (2013.01); *A41B 9/001* (2013.01); *A41F 17/00* (2013.01)

(58) Field of Classification Search

CPC .. A41B 9/14; A41B 9/02; A41B 9/001; A41B 9/008; A41B 17/00; A41B 2400/44; A41B 2400/80; A41B 1/10; A41B 11/126; A41B 17/005; A41B 9/04; A41B 9/08; A41F 17/00; A41F 9/00; A41F 9/002; A41F 9/02; A41F 17/04; A41F 1/08; A41F 3/02; A41F 5/00; A41F 11/14; A41F 13/00; A41F 15/00; A41F 9/025; A41F 7/00; A41D 3/00; A41D 1/00; A41D 2200/10; A41D 17/00; A41D 27/20; A41D 7/00

USPC .... 2/76, 78.1, 78.3, 78.4, 79, 109, 220, 221, 2/222, 223, 236, 237, 312, 315, 338, 378, 2/400, 401, 403, 406

See application file for complete search history.

(56) References Cited

U.S. PATENT DOCUMENTS

| | | | | |
|---|---|---|---|---|
| 932,640 A * | 8/1909 | Pfiffner | ..... | A41D 15/00 2/117 |
| 2,663,027 A * | 12/1953 | Posson | ..... | A41F 9/025 2/237 |
| 3,174,482 A * | 3/1965 | Parrott | ..... | A41B 9/02 2/404 |
| 7,124,448 B2 * | 10/2006 | Davenport | ..... | A41B 9/001 2/229 |

(Continued)

*Primary Examiner* — Khoa D Huynh
*Assistant Examiner* — Grace Huang

(57) ABSTRACT

An underwear with shirt tucking apparatus includes a lower undergarment, a second waist band, a plurality of attachments, and a plurality of gaps. The second waist band is circumferentially positioned around a first waist band of the lower undergarment and connected to the first waist band by the attachments. The attachments include a sagittal attachment, a first lateral attachment, and a second lateral attachment as the sagittal attachment is positioned along a sagittal plane of the lower undergarment and adjacent to a front section of the lower undergarment. The first lateral attachment and the second lateral attachment are positioned adjacent to a rear section of the lower undergarment. Resultantly, the sagittal attachment, the first lateral attachment, and the second lateral attachment are equally spaced around a circumference of the first waist band, delineating the plurality of gaps for a shirt to be tucked.

4 Claims, 5 Drawing Sheets

(56) References Cited

U.S. PATENT DOCUMENTS

| | | | | |
|---|---|---|---|---|
| 7,793,359 | B2 * | 9/2010 | Spiewak | A41D 1/002 2/247 |
| 9,015,864 | B2 * | 4/2015 | Evans | A41F 5/00 2/227 |
| 9,723,885 | B2 * | 8/2017 | Shoraka | A41C 1/08 |
| 2006/0010559 | A1 * | 1/2006 | Hamlet | A41B 1/08 2/117 |
| 2007/0000012 | A1 * | 1/2007 | Davenport | A41B 9/001 2/69 |
| 2009/0049584 | A1 * | 2/2009 | Stones | A41F 5/00 2/221 |
| 2010/0186149 | A1 * | 7/2010 | Miller | A41F 9/00 2/337 |
| 2012/0311758 | A1 * | 12/2012 | Nicholson | A41D 27/20 2/67 |
| 2014/0304899 | A1 * | 10/2014 | Almonte | A41B 9/001 2/403 |
| 2015/0007374 | A1 * | 1/2015 | Larson | A41D 7/00 2/67 |
| 2015/0230531 | A1 * | 8/2015 | Merchen | A41F 17/00 2/400 |
| 2016/0100642 | A1 * | 4/2016 | Swan | A41F 9/007 2/236 |
| 2016/0324238 | A1 * | 11/2016 | Tran | A41F 5/00 |
| 2017/0245568 | A1 * | 8/2017 | Peral | A41B 9/02 |
| 2018/0317564 | A1 * | 11/2018 | Tanenbaum | A41B 9/023 |
| 2019/0029346 | A1 * | 1/2019 | Peral | A41B 9/02 |

* cited by examiner

UNDERWEAR WITH SHIRT TUCKING APPARATUS

The current application claims a priority to the U.S. Provisional Patent application Ser. No. 62/335,548 filed on May 12, 2016 and the U.S. Provisional Patent application Ser. No. 62/363,810 filed on Jul. 18, 2016.

FIELD OF THE INVENTION

The present invention relates generally to a pair of underwear with a shirt tucking apparatus. More particularly, the present invention is a pair of underwear with a second elastic band that is attached to the pair of underwear at three different points thus providing openings for a shirt to tuck into.

BACKGROUND OF THE INVENTION

Tucking in a shirt has been a tradition with business casual, business, and formal attire. The shirt is generally tucked inside the pants to maintain the aforementioned attire; however, the shirt does not always remain in a tucked position due to physical activities of the wearer. People tend to use belts to keep the shirt in a tucked position but belts do not always maintain the shirt in a tucked position when the wearer engages in multiple physical activities. For example, the shirt usually becomes untucked when raising one's arms, getting up from a seated position, and lifting objects.

It is therefore an objective of the present invention to provide an apparatus which can help keep shirts in a tucked position. More specifically, the present invention includes a second elastic band that is attached to a first elastic band of an underwear at three different locations thus providing openings for a shirt to be tucked in. The second elastic band is made of elastic material and holds the shirt in a tucked position when the second elastic band is in a compressed state around the wearer's waist. The present invention also provides optional friction band sets that are externally positioned on the first elastic band to help grip the shirt from the inside, providing another means to keep the shirt in a tucked position.

DETAIL DESCRIPTION OF THE INVENTION

All illustrations of the drawings are for the purpose of describing selected versions of the present invention and are not intended to limit the scope of the present invention.

Figure 1:
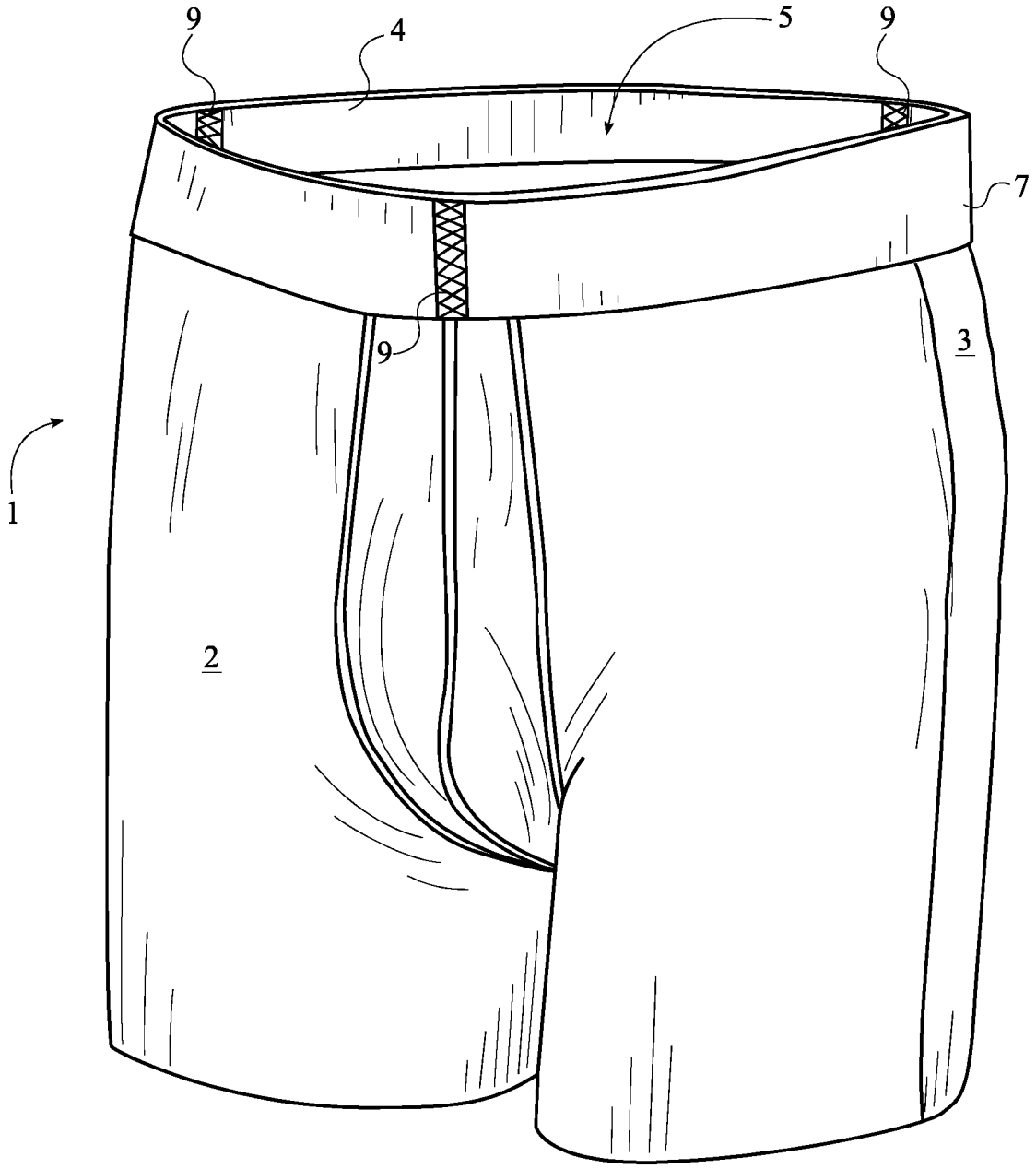
FIG. 1 is a perspective view of the present invention with second band is in the compressed state.
Figure 2:
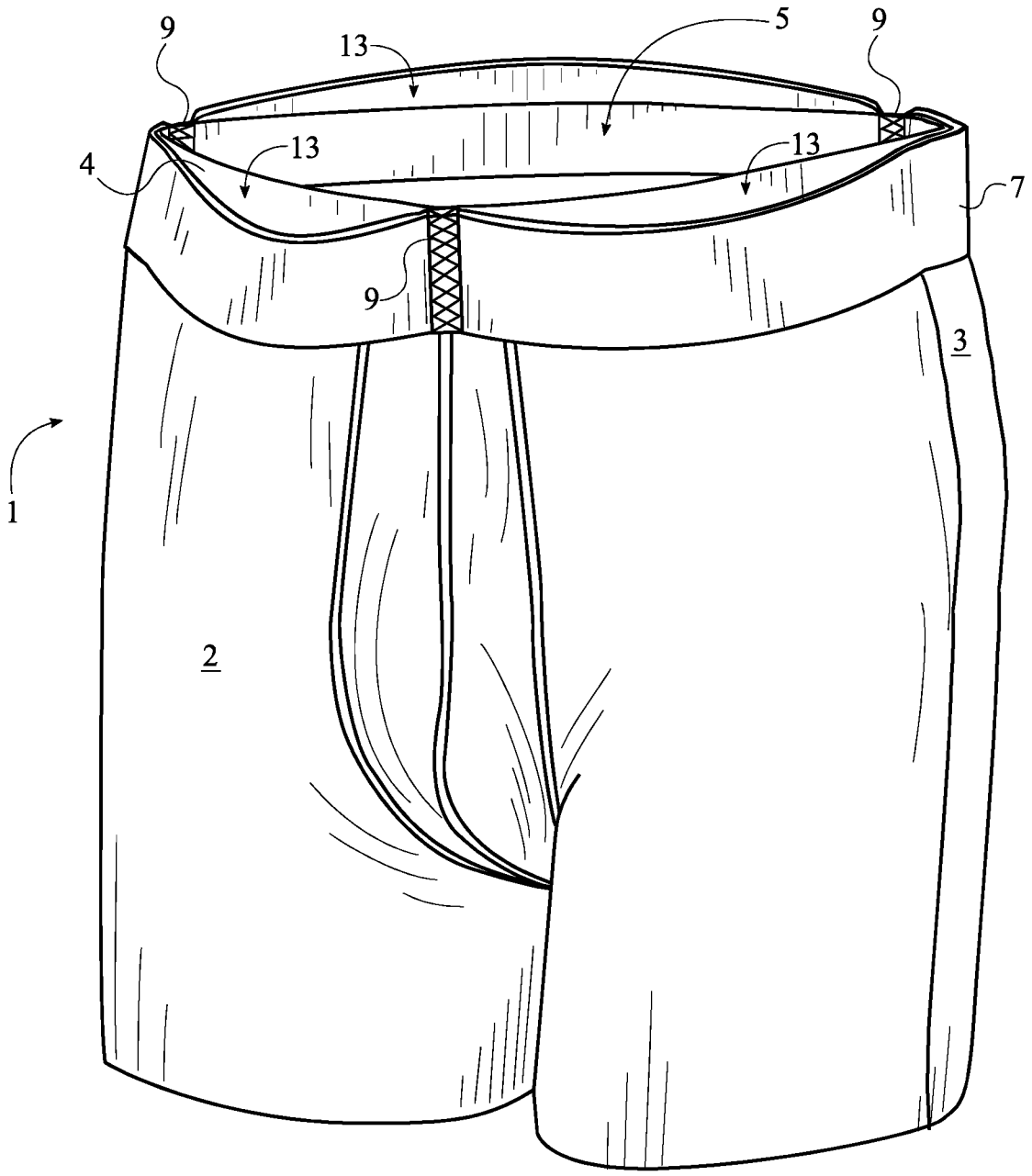
FIG. 2 is a perspective view of the present invention with the second band is in the stretched state.

The present invention is an underwear with shirt tucking apparatus so that a wearer can keep shirts in a tucked position during daily physical activities such as raising arms, bending, and sitting. The present invention efficiently maintains the tucked position for a shirt due to its component configuration and does not compromise the comfort of the wearer. As shown in FIG. 2, the present invention comprises a lower undergarment 1, a second waist band 7, a plurality of attachments 9, and a plurality of gaps 13. In reference to a general configuration, the second waist band 7 is circumferentially positioned around a first waist band 4 of the lower undergarment 1 and externally connected to the first waist band 4 by the plurality of attachments 9. As a result, the second waist band 7 fully covers the first waist band 4 and visually provides a single waist band appearance for the lower undergarment 1. The first waist band 4, the second waist band 7, and the plurality of attachments 9 jointly delineate the plurality of gaps 13 within the present invention. The plurality of gaps 13 allows the wearer to insert a bottom hem of the shirt as the second waist band 7 is in a stretched state. Then, the second waist band 7 is able to press the shirt against the first waist band 4 and maintain the tucked position for the shirt as the second waist band 7 is in a compressed state.

Figure 3:
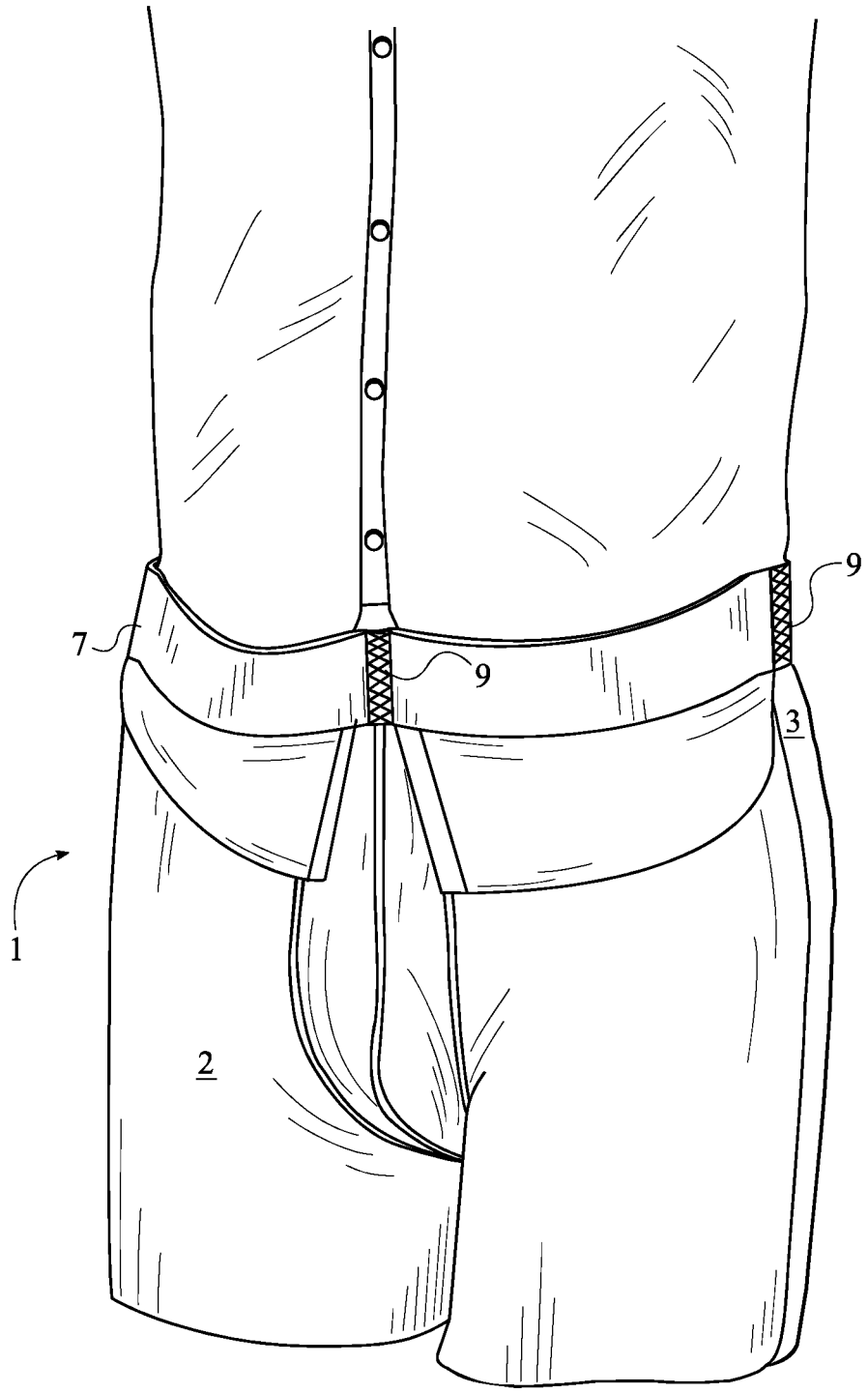
FIG. 3 is a perspective view of the present invention with a shirt is tucked inside the plurality of gaps.

The lower undergarment 1 that is utilized within the present invention can be men's lower undergarments or women's lower undergarments as long as the lower undergarment 1 comprises the first waist band 4. The lower undergarment 1 may be shaped as any type of underwear such as briefs, boxer briefs, panties, or boxers. The lower undergarment 1 may be any color or color combination, made of any material such as cotton, and any size to fit different body sizes. In reference to FIG. 2-4, the lower undergarment 1 further comprises a front section 2, a rear section 3, a torso opening 5, and a pair of leg openings 6 in addition to the first waist band 4. More specifically, the front section 2 and the rear section 3 are terminally connected to each other thus forming the main body of the lower undergarment 1. The pair of leg openings 6 is delineated by the front section 2 and the rear section 3 from the bottom end of the lower undergarment 1 through the connections of the front section 2 and the rear section 3. The first waist band 4 is perimetrically connected to the front section 2 and the rear section 3 from the top end of the lower undergarment 1, opposite of the pair of leg openings 6. As a result, the torso opening 5 is delineated by the first waist band 4. Similar to traditional under garment, the wearer can insert their left leg and right leg into the lower undergarment 1 through the torso opening 5 and the pair of leg openings 6 so that the first waist band 4 can be positioned around the waist of the wearer. The first waist band 4 and the second waist band 7 are preferably made of elastic material so that the first waist band 4 and the second waist band 7 can be firmly fits around the waist of the wearer and the shirt, respectively.

Figure 4:
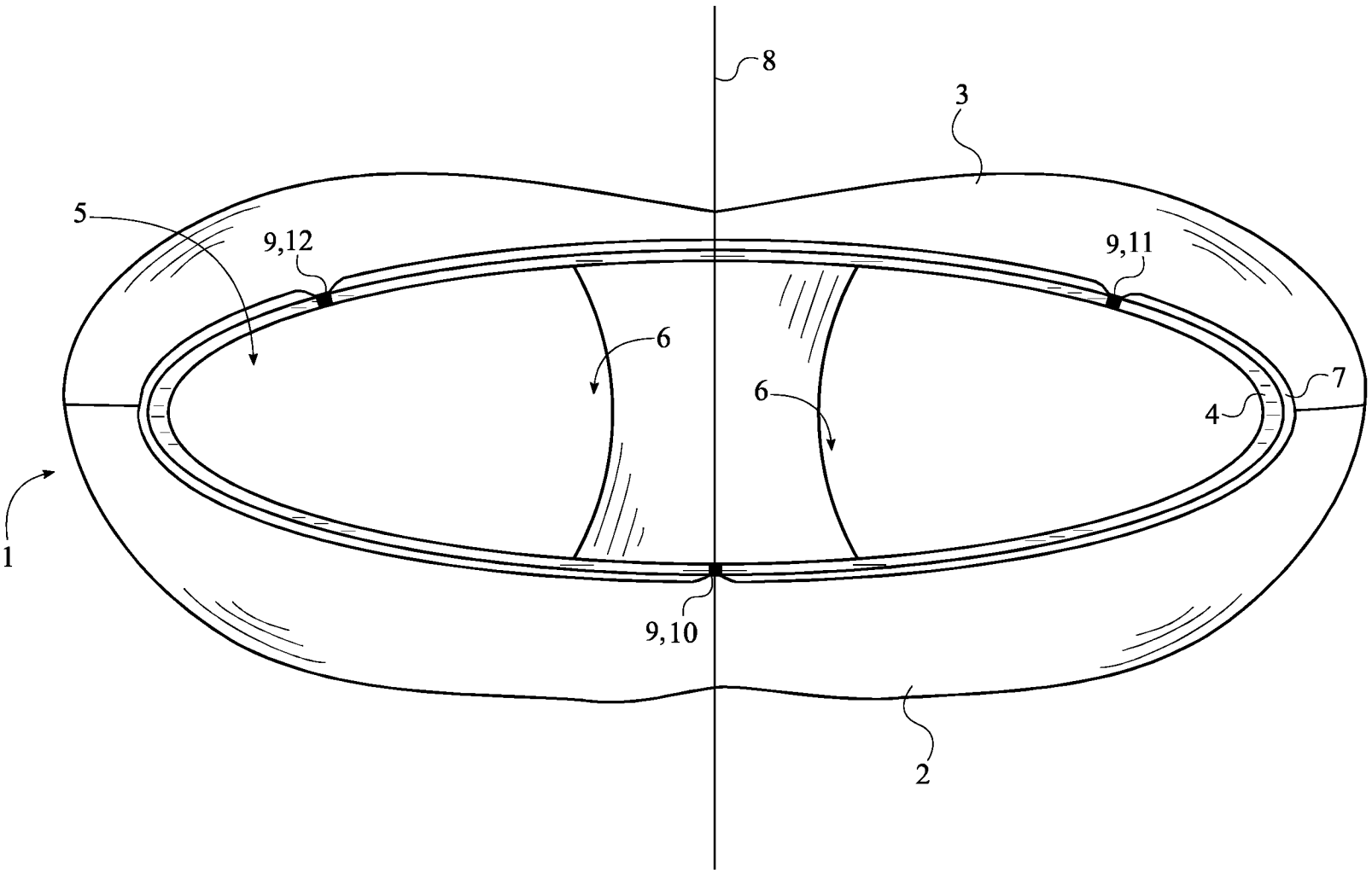
FIG. 4 is a top view of the present invention with the second band is in the compressed state.
Figure 5:
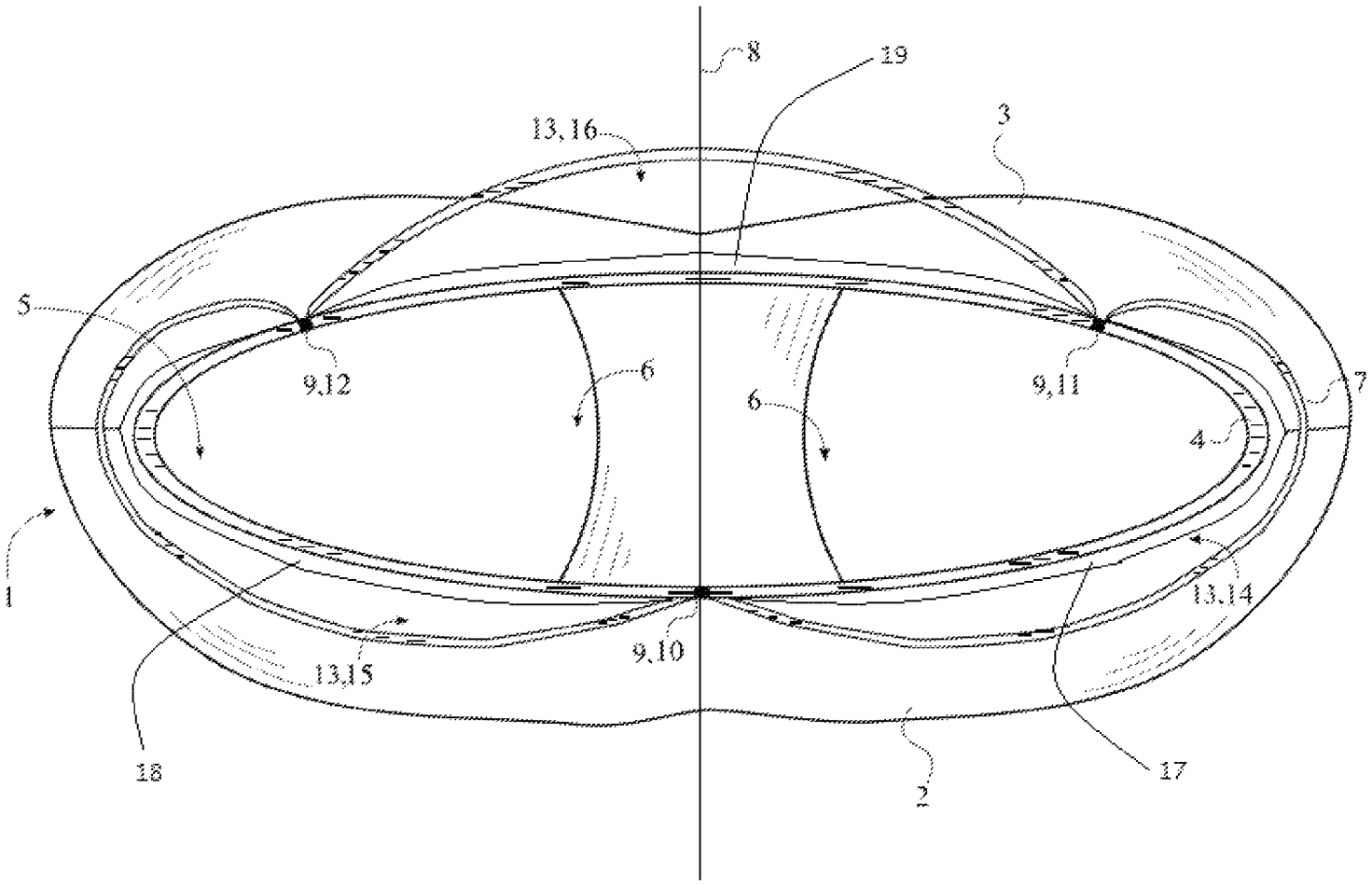
FIG. 5 is a top view of the present invention with the second band is in the stretched state.

The plurality of attachments 9 that secures the second waist band 7 to the first waist band 4 within the present invention comprises a sagittal attachment 10, a first lateral attachment 11, and a second lateral attachment 12 as shown in FIG. 4-5. The sagittal attachment 10, the first lateral attachment 11, and the second lateral attachment 12 define the three different attachments of the present invention so that the second waist band 7 is able to maximize the result of the tucked position. More specifically, the sagittal attachment 10 is positioned adjacent to the front section 2. The first lateral attachment 11 and the second lateral attachment 12 are positioned adjacent to the rear section 3, wherein the first lateral attachment 11 and the second lateral attachment 12 are positioned opposite of each other about a sagittal plane 8 of the lower undergarment 1. As a result, the second waist band 7 is connected to the first waist band 4 by the sagittal attachment 10 about the front section 2, along the sagittal plane 8 of the lower undergarment 1. The second waist band 7 is also connected to the first waist band 4 by the first lateral attachment 11 and the second lateral attachment 12 about the rear section 3. Additionally, the sagittal attachment 10, the first lateral attachment 11 and the second lateral attachment 12 are separated from each other along a circumference of the first waist band 4. Preferably, the sagittal attachment 10, the first lateral attachment 11, and the second lateral attachment 12 are equally spaced around the circumference of the first waist band 4 with similar arc lengths. In the preferred embodiment, each of the plurality of attachments 9 is a stitching that extends from a top end of both the first waist band 4 and the second waist band 7 to a bottom end of both the first waist band 4 and the second waist band 7. However, each of the plurality of attachments 9 is not limited to a stitching and can include other types of attachments such as hook and loop fasteners, male and female fasteners, button and loop fasteners, and adhesive fasteners.

The plurality of gaps 13 that allows the shirt to be inserted is delineated with the positioning of the first waist band 4, the second waist band 7, and the plurality of attachments 9. In reference to FIG. 5, the plurality of gaps 13 comprises a first gap 14, a second gap 15, and a third gap 16 with reference to the positioning of the sagittal attachment 10, the first lateral attachment 11, and the second lateral attachment 12. More specifically, the first gap 14 is positioned in between the sagittal attachment 10 and the first lateral attachment 11 thus extending from the front section 2 to the rear section 3. The second gap 15 is positioned in between the sagittal attachment 10 and the second lateral attachment 12 thus extending from the front section 2 to the rear section 3. The third gap 16 is positioned in between the first lateral attachment 11 and the second lateral attachment 12 in such a way that the third gap 16 extends along the rear section 3.

The present invention can optionally comprise a first friction strip 17, a second friction strip 18, and a third friction strip 19, providing additional support to keep the shirt in the tucked position. More specifically, the first friction strip 17 is externally superimposed over the first waist band 4 and positioned within the first gap 14. The second friction strip 18 is externally superimposed over the first waist band 4 and positioned within the second gap 15. The third friction strip 19 is externally superimposed over the first waist band 4 and positioned within the third gap 16. As a result, the first friction strip 17, the second friction strip 18, and the third friction strip 19 grasp an inside surface of the shirt while the second waist band 7 compresses an outside surface of the shirt.

The shirt comprises a first front panel, a second front panel, and a rear panel. In reference to FIG. 3 and FIG. 5, the first front panel is preferably a left panel and the second front panel is preferably a right panel as the shirt is inserted through the plurality of gaps 13. In reference to the insertion and the tucked position of the shirt, the first front panel is inserted through the first gap 14 that is created through the stretched state of the second waist band 7. The arc length between the sagittal attachment 10 and the first lateral attachment 11 allows the first front panel to be inserted as the compressed state of the second waist band 7 secures the first front panel against the wearer's body. Likewise, the second front panel is inserted through the second gap 15 that is created through the stretched state of the second waist band 7. The arc length between the sagittal attachment 10 and the second lateral attachment 12 allows the second front panel to be inserted as the compressed state of the second waist band 7 secures the second front panel against the wearer's body. The rear panel is inserted through the third gap 16 that is created through the stretched state of the second waist band 7. The arc length between the first lateral attachment 11 and the second lateral attachment 12 allows the rear panel to be inserted as the compressed state of the second waist band 7 secures the rear panel against the wearer's body. A left hem gusset of the shirt, which is positioned in between the first front panel and the rear panel, is positioned about the first lateral attachment 11 in order to minimize unnecessary material collection of the shirt from the left side. Similarly, a right hem gusset of the shirt, which is positioned in between the second front panel and the rear panel, is positioned about the second lateral attachment 12 in order to minimize unnecessary material collection of the shirt from the right side.

Although the invention has been explained in relation to its preferred embodiment, it is to be understood that many other possible modifications and variations can be made without departing from the spirit and scope of the invention as hereinafter claimed.

What is claimed is:

1. An underwear with shirt tucking apparatus comprising:
- a lower undergarment;
- a first waist band;
- a second waist band;
- a sagittal attachment;
- a first lateral attachment;
- a second lateral attachment;
- a first gap;
- a second gap;
- a third gap;
- a first friction strip;
- a second friction strip;
- a third friction strip;
- the lower undergarment comprising a front section, a rear section, a torso opening and a pair of leg openings;
- the front section and the rear section are terminally connected to each other;
- the torso opening being delineated by the front section and the rear section;
- the pair of leg openings being delineated by the front section and the rear section;
- the torso opening being oppositely located to the pair of leg openings;
- the first waist band being perimetrically connected to the front section and the rear section;
- the first waist band surrounding the torso opening;
- the second waist band being circumferentially positioned around the first waist band;
- the sagittal attachment being adjacently located to the front section;
- the sagittal attachment being positioned on a sagittal plane of the lower undergarment;
- the first lateral attachment and the second lateral attachment each being adjacently located to the rear section;
- the first lateral attachment and the second lateral attachment being oppositely located to each other about the sagittal plane;
- the sagittal attachment, the first lateral attachment and the second lateral attachment being distributed on a circumference of the first waist band;
- the sagittal attachment, the first lateral attachment and the second lateral attachment being separated from each other along the circumference;
- the second waist band being externally connected to the first waist band by the sagittal attachment, the first lateral attachment and the second lateral attachment;
- the first gap being delineated by the first waist band, the second waist band, the sagittal attachment and the first lateral attachment;

the second gap being delineated by the first waist band, the second waist band, the sagittal attachment and the second lateral attachment;

the third gap being delineated by the first waist band, the second waist band, the first lateral attachment and the second lateral attachment;

the first friction strip, the second friction strip and the third friction strip each being externally superimposed on the first waist band;

the first friction strip being positioned within the first gap;

the second friction strip being positioned within the second gap;

the third friction strip being positioned within the third gap; and the first friction strip, the second friction strip and the third friction strip being configured to grasp an inside surface of a shirt while the second waist band being configured to compress an outside surface of the shirt.

2. The underwear with shirt tucking apparatus as claimed in claim 1, wherein the first waist band being elastic.

3. The underwear with shirt tucking apparatus as claimed in claim 1, wherein the second waist band being elastic.

4. The underwear with shirt tucking apparatus as claimed in claim 1, wherein the sagittal attachment, the first lateral attachment and the second lateral attachment are equally separated from each other along the circumference.

* * * * *